United States Patent [19]

Whitney

[11] Patent Number: 4,575,278

[45] Date of Patent: Mar. 11, 1986

[54] RAIN DRAINING LANE MARKER

[76] Inventor: James R. Whitney, 4886 Old Well Rd., Annandale, Va. 22003

[21] Appl. No.: 459,224

[22] Filed: Jan. 19, 1983

[51] Int. Cl.[4] ..... E01C 23/16; E01C 23/09; E01F 9/04

[52] U.S. Cl. ..... 404/72; 404/14; 404/94

[58] Field of Search ..... 404/9, 12, 14, 15, 16, 404/93, 96, 72; 52/102; 452/94

[56] References Cited

U.S. PATENT DOCUMENTS

| | | | |
|---|---|---|---|
| 1,746,312 | 2/1930 | Lee | 404/15 |
| 1,986,591 | 1/1935 | Meyer | 404/14 X |
| 2,153,392 | 4/1939 | Robertson | 404/16 |
| 2,185,020 | 12/1939 | Vostrez | 404/14 |
| 2,826,128 | 3/1958 | Summers | 404/12 |
| 3,529,517 | 9/1970 | Liddle | 404/14 |
| 3,876,322 | 4/1975 | Deason | 404/2 |
| 4,035,059 | 7/1977 | DeMaster | 404/9 |
| 4,068,968 | 1/1978 | Gagle et al. | 404/7 |
| 4,129,673 | 12/1978 | Eigenmann | 404/9 |
| 4,199,541 | 4/1980 | McFarland | 404/96 |

FOREIGN PATENT DOCUMENTS

| | | | |
|---|---|---|---|
| 213439 | 2/1961 | Austria | 404/12 |
| 2000593 | of 1977 | Fed. Rep. of Germany | 404/93 |
| 1181762 | 6/1959 | France | 404/15 |
| 689791 | 4/1953 | United Kingdom | 404/6 |

OTHER PUBLICATIONS

*Roadway Delineation Practices Handbook,* PB82-207101, Federal Highway Administration, Sep. 1981.

*Driver's Visibility Requirements for Roadway Delineation vol. I. Effects of Contrast and Configuration on Driver Performance and Behavior,* PB-290 482, Federal Highway Administration, Nov. 1977.

"Highway Research Board Bulletin 57", Pavement Marking Materials, Annotated Bibliography, National Academy of Sciences-National Research Council, pp. 99-128.

*Primary Examiner*—Stephen J. Novosad

*Attorney, Agent, or Firm*—Thomas J. Greer, Jr.

[57] ABSTRACT

A lane marker for a road is defined by a generally convex strip formed, for example, from an asphalt slurry. The marker strip is placed on the road surface as by extrusion, the strip then compacted and provided with a reflective coating such as a light colored paint carrying glass particles. The coating may cover the entire strip, or may be defined by two parallel stripes. Rain drainage grooves also reflectively coated may be provided, the grooves extending across the marker strip. The marker strip exhibits particular utility during normal rainfall at night hours.

31 Claims, 7 Drawing Figures

FIG. 1
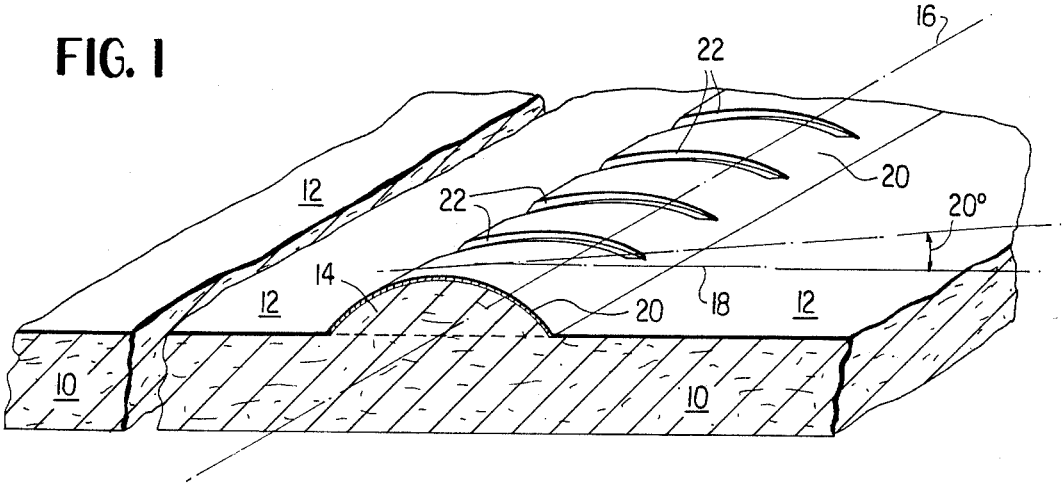
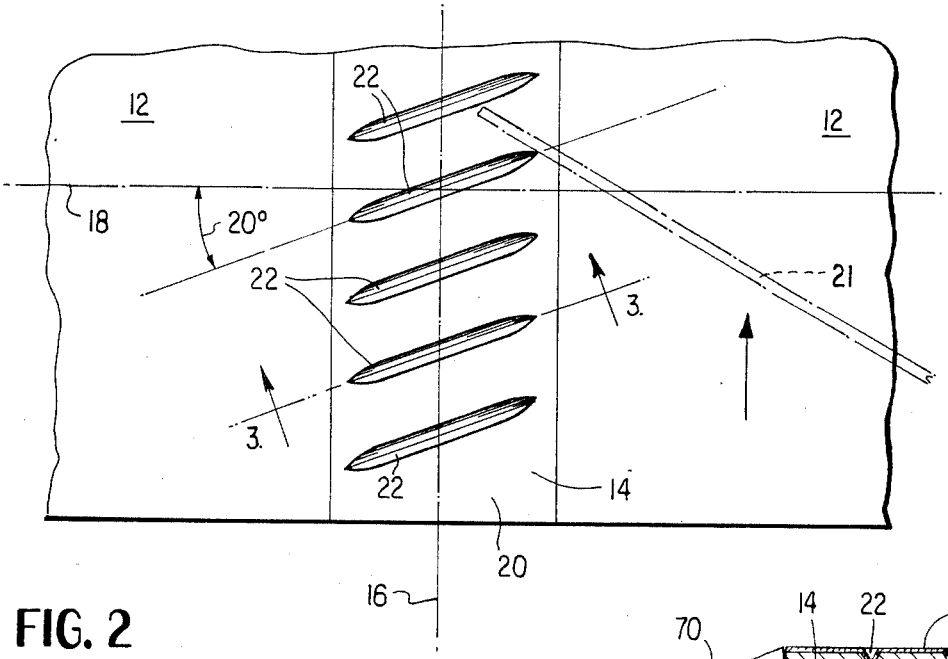
FIG. 2
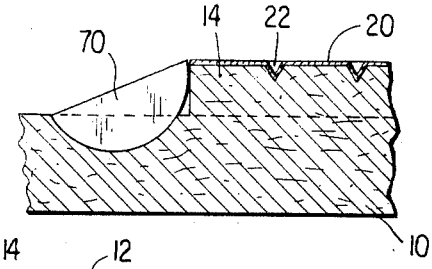
FIG. 7
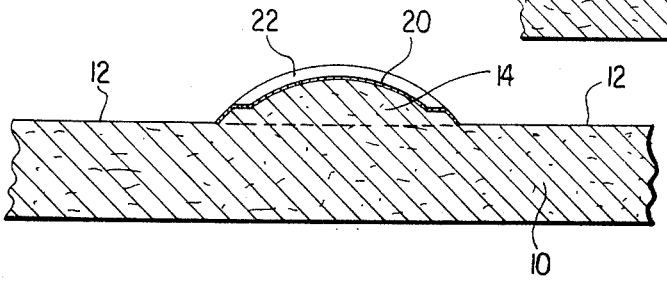
FIG. 3

RAIN DRAINING LANE MARKER

This invention relates to highway or road markers and more particularly to a traffic divider marker or a lane indicating device of the type adapted to reflect light from headlights and other ambient illumination to drivers. The invention displays particular utility during times of normal rain, i.e., less than so-called torrential rain, during night hours.

The prior art is aware of a variety of road marking devices and systems. The simplest of such arrangements involves painting a stripe of white, or yellow reflective material along the road. Other arrangements include discs with a variety of reflecting coatings, the discs usually being imbedded on and aligned along the road to define a median strip or marker. Other arrangements include plastic strips, either continuous or discontinuous, which may additionally be provided with reflecting devices.

The problem of decreased reflectivity of road markers due to rain, particularly at night, has not been completely solved by workers in this art. This is so of both continuous and discontinuous marking stripes as well as discs. In times of normal rain, water collects on the marking strip to thereby obscure its reflective coating. This results in a substantial decrease in visibility to drivers of the reflective coating (usually paint) on the marking stripe. Namely, the reflectivity of the stripe is diminished by virtue of a layer of water on its surface. The glare from ambient light, over the entire road surface as seen by a driver, is unbroken by the stripe.

According to the practice of this invention, the glare from oncoming vehicle headlights and other sources of ambient illumination, at night at times of normal rain, is broken to give a textured shadow line by the raised portion of the marking strip. In the case where there is little or no glare from oncoming traffic and other sources of illumination, the marking strip of this invention improves the visibility of the stripe from the driver's headlights. The marking strip is reflectively coated as by paint. The rain water drains from the sides faster than the rate of accumulation of water on the road. The reflecting stripe or stripes on the marking strip remain visible. This effects a breaking up of the texture of the light reflected from the strip, to thereby enhance the contrast between reflected ambient light from the road surface and reflected light from the marking stripe. The marking strip may be provided with grooves, whose valleys are also provided with a reflective coating.

The prior art is aware of somewhat similar arrangements. One arrangement employs grooves generally transverse to the axis of the road to thereby define a marking strip. This is shown in U.S. Pat. No. 2,185,020 issued to V. Vostrez which discloses a road 10 having an upper surface 11, one or more narrow zones 12, 13 of the latter being provided with sinusoidal undulations. The peaks of the undulations are above the road surface, while their valleys are below it. No reflective coating is employed. While the arrangement disclosed in the Vostrez patent displays some of the features of the present invention, the Vostrez construction employs grooves which are below the road surface. The undulations are impressed in the concrete before hardening, and hence the peaks of the undulations can only be formed at the time of making the road. Debris, ice and rain water will accumulate in the grooves to thereby diminish at times of normal rainfall the desired optical effect of providing contrast between the marking strip and the remainder of the road.

U.S. Pat. No. 2,579,467 issued to Brinkman also discloses a road market somewhat similar to that of the present invention. A rubber strip is provided with means to anchor the strip to parallel, concrete roadbed sections prior to the setting of the concrete. The upper strip surface is provided with a plurality of V-shaped ribs whose slanting surfaces are reflectively coated with paint or glass beads. The anchoring means of the strip ensures that the rubber strip will stretch to conform to changes in the roadbed sections. Otherwise there would be no means (at least disclosed) to affix the strip to the roadbed sections.

U.S. Pat. No. 3,011,412 issued to Harrington discloses a raised road marking strip defined by a paint layer 11 covered by a protective urea coating 12. However the protective coating 12 is dissolved and washed away by rain, as stated by and intended by Harrington. While structurally similar to the marking strip of this invention during its formation, the urea coating is temporary and vanishes after rainfall.

U.S. Pat. No. 4,035,059 issued to DeMaster shows an adhesive base sheet as of aluminum carrying an elastically deformable reflector whose upstanding sides are covered with retroreflectors. While displaying raised side portions, the DeMaster construction entails significant expense and is not integral with the road surface.

In accordance with the present invention, a marking strip is formed from asphalt or asphalt slurry. An asphalt slurry is an asphalt mixture with fine aggregates such as stone, or, it may consist of epoxy and stone. The strip may be applied at the time of making the road, or may be applied thereafter. The strip is raised from the road surface and is substantially integral with it. The surface of the strip is coated with paint or other reflecting coating in the normal striping configuration. Grooves may be applied to the strip, preferably immediately after its formation on the road surface. The grooves are also reflectively coated in the normal striping configuration, the grooves preferably running at an angle with respect to the longitudinal axis of the road. The orientation of the angle of the grooves is selected so that the grooves lie at approximate right angles with respect to a snow plow blade, thus minimizing damage due to the lower edge of a snow plow blade running parallel over the rain drainage grooves. The presence of the grooves further enhances the difference in texture of light reflected from the marker, as will later be more fully set out.

IN THE DRAWINGS

FIG. 1 is a cross-sectional and perspective view of a road marker system according to one embodiment of this invention.

FIG. 2 is a partial top plan view of the road marker system of FIG. 1

FIG. 3 is a view taken along section 3—3 of FIG. 2.

FIG. 7 is a partial cross-sectional view showing a protective wedge placed at the beginning of a marker strip, to protect it against a snow plow blade.

Figure 4:
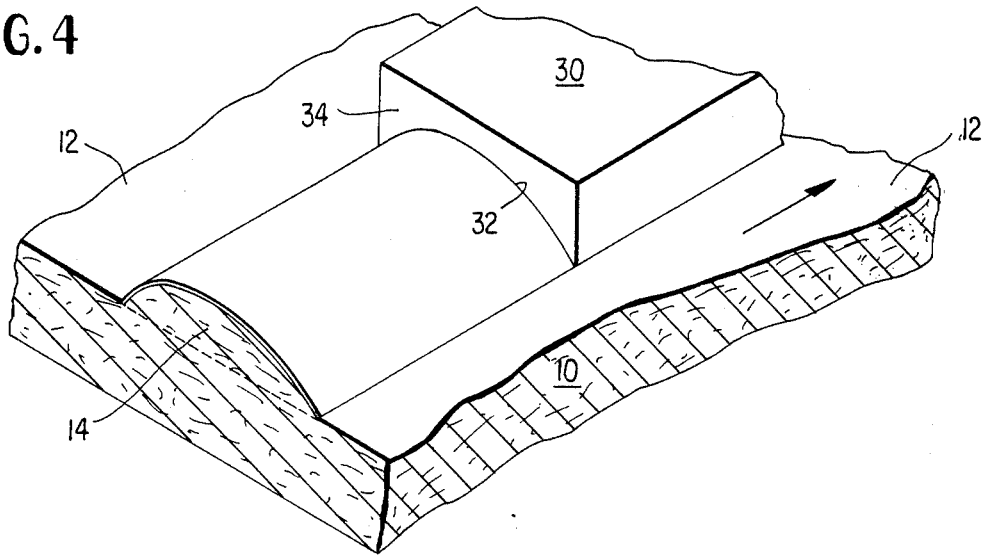
FIG. 4 is a partial perspective view, similar to FIG. 1, and illustrates one method of forming the road marker strip of this invention on an existing road.

Referring now to FIG. 1 of the drawings, the numeral 10 denotes generally a roadbed formed from asphalt or from an asphaltic composition and having a surface 12. Alternatively, the road or roadbed 10 may be formed of concrete. As will become apparent from the following description, the material of construction of road 10 is not significant. The numeral 14 denotes the marker strip of this invention and is most economically fashioned from an asphaltic slurry composition. The numeral 16 denotes the longitudinal axis of the road marker and is parallel with the longitudinal axis of the road 10. The numeral 18 denotes an imaginary line at right angles to axis 16. The numeral 20 denotes a reflective coating on the convex marker 14, the coating commonly assuming the form of white paint carrying therein a dispersion of small glass spheres or glass particles to increase the reflectivity. It will be understood that the color of the paint is not critical for carrying out the invention, although a paint of light color is generally employed. The numeral 22 denotes any one of a plurality of grooves extending generally from one side to the other side of marker strip 14. The grooves are shown as terminating short of the road surface, although they may extend completely to the road surface. Preferably, the grooves are at an angle with respect to the longitudinal axis 16 of the marker, as may be seen by reference to FIG. 2. There, the angle is seen to be about 20°. The double dashed lines 21 denote the position of a conventional snow plow blade moving in the direction indicated by the solid arrow. The snow plow is generally at an angle of about 20° with respect to the line 18, the angle of the snow plow blade approaching a right angle with respect to the orientation of the longitudinal axis of each of the grooves 22. By thus forming the grooves 22 at an angle, the probability of the lower edge of the snow plow blade engaging and chipping the sides of the grooves 22 is minimized. FIG. 2 shows the case wherein the snow plow blade is moved along the right hand side of the road, with marker 14 positioned in the center.

FIG. 3, a cross-section of the strip, shows that each groove 22 is arcuate, following the outer contour of strip 14 to give more strength to the marker as compared to a construction wherein the grooves 22 where horizontal.

FIG. 4 illustrates a method for forming the divider strip 14 according to the first embodiment of this invention. The numeral 30 denotes a bottomless box of the same type often used for placing asphalt on roadbeds to form asphalt road or asphalt road toppings. Its construction and manner of supply of asphalt slurry are both well known and need not be set forth. The numeral 32 denotes an arcuate opening in the rear wall 34 of box 30. Assuming that the road 12 is already in existence and that it is desired to place a road marker strip 14 of this invention on the road, the open bottom box 30 is filled with flowable asphalt slurry of any conventional type and is moved in the direction indicated by the arrow. The effect of this movement is the flowing of the asphalt slurry through opening 32 and onto the top surface 12 of road 10. The net result is a kind of extrusion of the marker strip 14 onto the road. While marker strips 14 may be laid intermittently, i.e., to produce so-called skip-type markers, it may be less expensive to place one continuous stripe 14 and, if marker stripe discontinuities are desired, to reflectively coat spaced segments or sections of the continuous strip 14.

Figure 5:
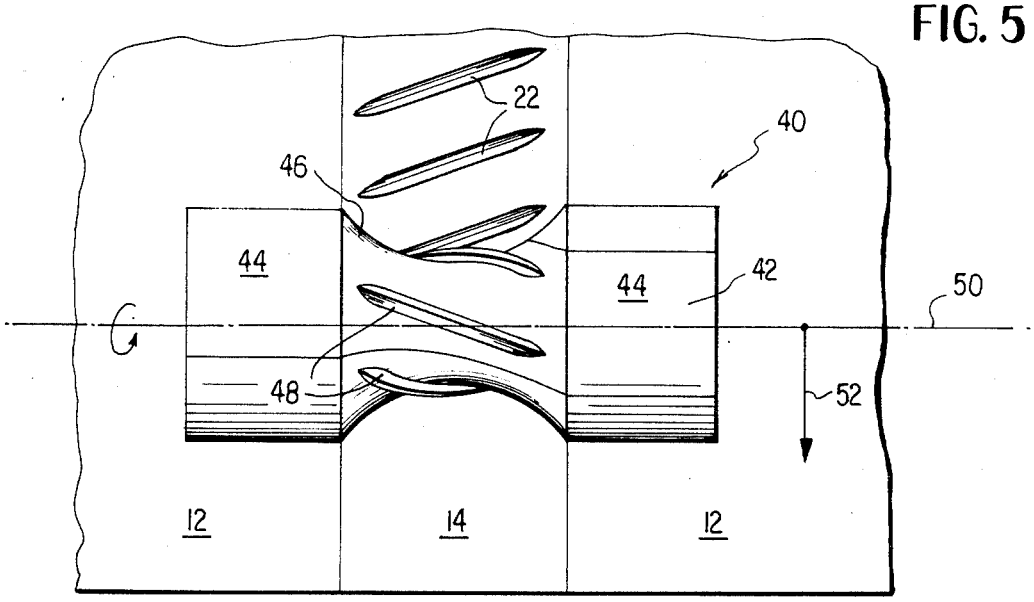
FIG. 5 is a view similar to FIG. 4, and shows one method and apparatus for forming rain drainage grooves in the marker strip of the embodiment of FIG. 1 of this invention.

Referring now to FIG. 5 of the drawings, one method of placing grooves 22 in the strip 14 is illustrated. The numeral 40 denotes a generally cylindrical roller, preferably hollow, and fashioned from a plurality of annular segments 42. The numeral 44 denotes the lateral portions of the roller 40, with numeral 46 denoting a concave groove. The external surfaces of groove 46 are provided with raised bar or rib elements 48 which are slanted in the manner indicated, much as in the appearance of slanted gear teeth. Immediately or soon after the fresh formation of strip 14, roller 40 is moved in the direction indicated by arrow 52 by rolling along the surface 12 of road 10, with bar elements 48 being impressed into the relatively soft convex surface of strip 14 to thereby form grooves 22 at the indicated angle. Clearly, the angle of grooves 22 with respect to the road is dependent upon the angle at which bar elements 48 are placed in groove 46. In practice, cylinder 40 may be fashioned so as to fit over an existing cylindrical roller element of the common self-propelled road pressing or rolling machine. The groove 46 and bar elements 48 perform the dual function of both compressing the freshly laid or freshly extruded strip 14 and in placing the grooves 22 therein.

It will be further understood that the placing of the grooves 22 in the strip may be accomplished in other ways, such as by a hand operated stamping device whose bottom is provided with bars to form grooves 22.

After the formation of the strip 14 and grooves 22, a coating 20 of a reflective material, such as white paint mixed with small glass beads is applied, covering the surface of the strip 14 and the surfaces of grooves 22. The distribution of reflective coating over the marker 14 may be varied. Thus, as earlier discussed, the coating may be discontinuous. Further, individual reflective stripes may be placed along the sides only of the marker 14, leaving the top uncoated.

Figure 6:
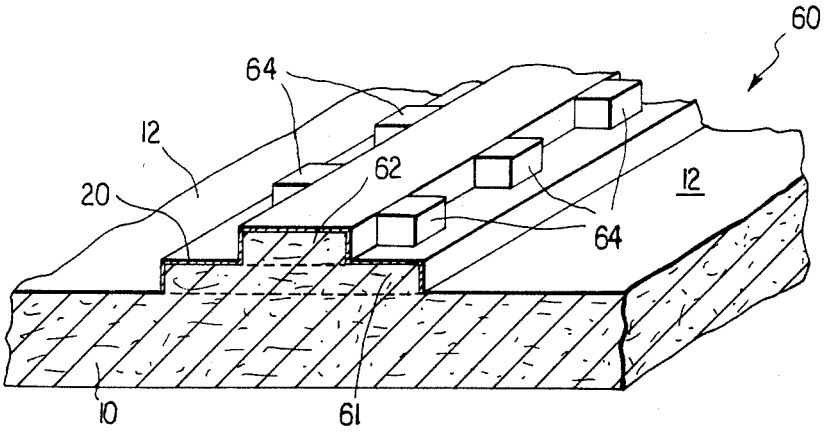
FIG. 6 is a view similar to FIG. 1 and illustrates a second embodiment of the road marker stripe of this invention.

Referring now to FIG. 6 of the drawings, an embodiment is illustrated wherein the marker strip assumes the form of a stepped strip. The stepped strip is denoted generally by the numeral 60 and may be considered as fashioned from a first or lower rectangular strip 61 on which is placed a second and narrower upper rectangular strip 62. Both strips 61 and 62 are coated with a reflective covering 20, such as a light colored paint with glass particles therein. The marker strip 60 may be formed in a manner similar to that described with respect to FIG. 4.

The mode of operation of the road marking system of both embodiments is as follows. In times of normal rain, water flows off of the sides of strip 14 of the embodiment of FIG. 1 and off of the vertical sides of the stepped structure 60 of the embodiment of FIG. 6 at a rate greater than it flows away from the road surface 12. Further, in the embodiment of FIG. 1, water flows from the grooves or troughs 22 also at a rate faster than it flows off of the top of the strip 14. The glare from oncoming headlights from other vehicles, is thus broken up by the difference of the strip and the road surface 12. This creates a difference in texture, to thereby make more visible the marker strip. The presence of the grooves 22 also contributes to a texture difference in reflected light. The sides of the groove reflect light, in general, differently from the light reflected from the sides of strip 14. In practice, the grooves may be spaced from each other so as to yield a rumble noise effect to apprise a driver that his tires are on the strip. If desired, grooves such as 22 of the embodiment of FIG. 1 may be employed in combination with the stepped strip of FIG. 6. A typical ratio of strip height to strip width is about 1 to 20. Thus for a strip of one foot width, the height would be about one-half inch.

Additionally, separate, spaced reflectors may be added to the marker strip 14 in grooves 22 as well as along the lower sides of the marker strip. In the embodiment of FIG. 6, reflectors may be placed on the corners at the base of the upper surface 62 at the junction between the horizontal surfaces of strip 61 and the vertical surfaces of strip 62. This is shown at FIG. 6 by reflectors, shown as conventional corner cube reflectors 64, spaced along the marker strip and on both sides thereof. Further, a metal strip may be embedded into the road surface at the beginning of each marker strip, to protect the strip from the initial impact of a snow plow. This is shown at FIG. 7 by metal wedge 70 having an inclined straight edge running from the road surface to the upper level of the marker strip. Still further, a metal strip may run the entire length in the center of the marker strip to allow the snow plow to ride on a harder surface to protect the marker strip. Although the reflective coating 20 has been described as light colored paint carrying small glass reflecting particles, it will be understood that other coverings may be used, such as reflective thermoplastic, epoxy, conformable tape.

While road or roadbed 10 has been illustrated as a single slab, it is often the practice to form the road by placing two slabs beside each other, such as two twelve foot wide asphalt or concrete slabs. The placing of marker 14 on top of the road at the juncture of the two slabs will aid in the prevention of spalling of the joint or juncture.

What is claimed is:

1. A traffic lane marker system, including a road, a solid raised marking strip on the road having at least one reflecting stripe thereon, the stripe carrying small, reflectivity-increasing glass spheres or glass particles therein, the at least one stripe running longitudinally with the marking strip, the marking strip being narrower than the road and following the curvature of the road, the marking strip lying above the road surface, at least the major part of the surface of the raised marking strip having sloping sides to drain rain from its surface, the marking strip being formed from asphalt, asphalt slurry or epoxy and stone, whereby the marking strip permits increased visibility of the marking strip during darkness hours, during times of rain, to thereby enhance the contrast between the marking strip and the road surface.

2. The traffic lane marker system of claim 1, wherein at least the major portion of the top surface of the marking strip is generally arcuate in cross-section.

3. The traffic lane marker system of claim 1, wherein the strip is positioned along the center of the road.

4. The traffic lane marker system of claim 1, wherein the marking strip has a ratio of width to height of at least 5 to 1 preferably about 20 to 1.

5. The traffic lane marker system of claim 1, wherein at least one end of the marking strip is provided with an inclined wedge to protect the marking strip from the initial impact of a snow plow blade.

6. The traffic lane marker system of claim 1, wherein the road is formed by two asphalt slabs or by two concrete slabs placed beside each other and the marking strip is placed at the side juncture of the slabs to prevent spalling of the joint or juncture.

7. A traffic lane marker system, including a road, a solid raised marking strip on the road having at least one reflecting stripe thereon, the stripe carrying small, reflectivity-increasing glass spheres or glass particles therein, the at least one stripe running longitudinally with the marking strip the marking strip being narrower than the road and following the curvature of the road, the marking strip lying above the road surface, the raised marking strip having sloping sides to drain rain from its surface, rain drainage grooves being located in the strip, the grooves being at an angle to the longitudinal axis of the marking strip, whereby the marking strip permits increased visibility from the strip during darkness hours, during times of rain, to thereby enhance the contrast between the marking strip and the road surface.

8. The traffic lane marker system of claim 7 wherein the marking strip is formed from asphalt, asphalt slurry, or epoxy and stone.

9. The traffic lane marker system of claim 8, wherein the drainage grooves extend from one edge of the strip to its other edge.

10. The traffic lane marker system of claim 9, wherein the drainage grooves are also reflectively coated.

11. The traffic lane marker system of claim 8, wherein the drainage grooves are also reflectively coated.

12. The traffic lane marker system of claim 8, wherein the strip is positioned along the center of the road.

13. The traffic lane marker system of claim 8, wherein reflectors are located in said grooves.

14. The traffic lane marker system of claim 8, wherein the marking strip has a ratio of width to height of at least 5 to 1 and preferably about 20 to 1.

15. The traffic lane marker system of claim 8, wherein at least one end of the marking strip is provided with an inclined wedge to protect the marking strip from the initial impact of a snow plow blade.

16. The traffic lane marker system of claim 8, wherein the road is formed by two asphalt slabs or by two concrete slabs placed beside each other and the marking strip is placed at the side juncture of the slabs to prevent spalling of the joint or juncture.

17. The traffic lane marker system of claim 8, wherein at least the major portion of the top surface of the marking strip is generally arcuate in cross-section.

18. The traffic lane marker system of claim 7, wherein the drainage grooves extend from one edge of the strip to its other edge.

19. The traffic lane marker system of claim 18, wherein the drainage grooves are also reflectively coated.

20. The traffic lane marker system of claim 7, wherein the drainage grooves are also reflectively coated.

21. The traffic lane marker system of claim 7, wherein the strip is positioned along the center of the road.

22. The traffic lane marker system of claim 7, wherein the marking strip has a ratio of width to height of at least 5 to 1 and preferably about 20 to 1.

23. The traffic lane marker system of claim 7, wherein at least one end of the marking strip is provided with an inclined wedge to protect the marking strip from the initial impact of a snow plow blade.

24. The traffic lane marker system of claim 7, wherein reflectors are located in said grooves.

25. The traffic lane marker system of claim 7, wherein the road is formed by two asphalt slabs or by two concrete slabs placed beside each other and the marking strip is placed at the side juncture of the slabs to prevent spalling of the joint or juncture.

26. The traffic lane marker system of claim 7, wherein at least the major portion of the top surface of the marking strip is generally arcuate in cross-section.

27. A method of making a raised road marker strip for a road, including the steps of (1) extruding a generally convex strip of a flowable composition along a road to be marked so that the generally convex extruded marker strip lies on the top surface of the road (2) forming rain drainage grooves in the strip at an angle to the longitudinal axis of the road, (3) coating the strip with at least one reflecting stripe running longitudinally therewith.

28. The method of claim 27 wherein the flowable composition is of asphalt, asphalt slurry or epoxy and stone.

29. A method of making a raised road marker strip for a road, including the steps of (1) extruding a generally convex strip of a flowable composition along a road to be marked so that the generally convex extruded marker strip lies on the top surface of the road (2) pressing the extruded strip to compact it, (3) forming rain drainage grooves in the strip at an angle to the longitudinal axis of the road, (4) coating the strip with at least one reflecting stripe running longitudinally therewith.

30. The method of claim 29 wherein the flowable composition is of asphalt, asphalt slurry or epoxy and stone.

31. The method of claim 29 wherein the step (2) of compacting the strip is performed by rolling a cylindrical member having a concave groove in its outer surface over the marking, the groove being aligned with the marking strip, the groove having ribs which extend into the marking strip to thereby perform step (3) simultaneously with step (2).

* * * * *